United States Patent [19]

Hightower

[11] Patent Number: 4,747,174

[45] Date of Patent: May 31, 1988

[54] GROOMING ATTACHMENT FOR RECONDITIONING THE PLAYING SURFACE OF A TENNIS COURT

[76] Inventor: James H. Hightower, 172 N.E. Surfside Ave., Port St. Lucie, Fla. 33452

[21] Appl. No.: 78,057

[22] Filed: Jul. 27, 1987

[51] Int. Cl.[4] ..... E01H 1/02

[52] U.S. Cl. ..... 15/78; 15/49 R; 15/201

[58] Field of Search ..... 15/78, 81, 201, 172, 15/160, 79 R, 49 R; 254/327; 56/6, 7

[56] References Cited

U.S. PATENT DOCUMENTS

| | | | |
|---|---|---|---|
| 457,746 | 8/1891 | Myers | 56/6 |
| 600,222 | 4/1898 | Hasson | 15/78 |
| 1,189,016 | 6/1916 | Thompson | 56/6 |
| 1,555,630 | 9/1925 | Brock | 15/203 |
| 1,693,475 | 11/1928 | Clapper | 56/6 |
| 3,070,938 | 1/1963 | Winget | 56/6 |

FOREIGN PATENT DOCUMENTS

| | | | |
|---|---|---|---|
| 168658 | 6/1920 | United Kingdom | 15/201 |

*Primary Examiner*—Philip R. Coe
*Assistant Examiner*—D. Poffenberger
*Attorney, Agent, or Firm*—Frank P. Cyr

[57] ABSTRACT

A grooming attachment particularly adapted to reconditioning the playing surface of tennis courts. The attachment is adapted to be drawn by a motorized vehicle capable of travelling over the entire surface of the court and comprising a plurality of brush elements pivotally mounted on a suitable support connected to a conventional hitch which are capable of being manually moved from an operative brushing position to an elevated position whereby the brushes are capable of being brought into an upright position when it is desired to move the attachment from one place to another and particularly through the entrance gate of a court, the width being of a conventional area.

3 Claims, 1 Drawing Sheet

GROOMING ATTACHMENT FOR RECONDITIONING THE PLAYING SURFACE OF A TENNIS COURT

BACKGROUND OF THE INVENTION

The playing surfaces of tennis courts may consist of a concrete surface, an asphalt surface or most commonly used, a clay surface.

A clay surface comprises a mixture of clay having a number of small pebbles interspersed in the clay so as to provide a tractive surface for the court. This is the most commonly used surface for tennis courts. However, a clay surface court must, from time to time, be reconditioned so as to present a smooth surface for the playing area.

As can be appreciated, following use of the court by the players, the upper surface of the court is disturbed by the players in that a small number of the pebbles in the clay are caused to be dislodged above the playing surface of the court and when this occurs, it then becomes necessary to recondition the playing surface and to re-embed the pebbles into the clay so as to again present a smooth yet tractive playing surface.

Thus, with the above in mind, it is one of the primary objects of the invention to provide a means whereby the playing area of the court may be reconditioned following play thereon so as to redistribute the pebbles and subsequently force the pebbles back into the clay. Subsequently, the playing surface is watered and the court rolled with a rolling drum or the like.

Another object of the invention is to provide a motorized vehicle of a width consistent with the width of the pivoted brooms when in upright position so as to permit the vehicle and brooms to enter the entrance gate of a tennis court.

Another object of the invention is to provide for an easy accessible operating handle for the operator of the vehicle whereby the brushes may be caused to be elevated or lowered onto or from the playing surface of the court. Following reconditioning of the court with the brushes, the same may be elevated and the towing vehicle moved to a next location.

Another object of the invention is to provide a vehicle-drawn set of brushes which operate through a series of cables and pulleys whereby the operator of the vehicle, can, without removing himself from the operator's seat, manually effect the raising or lowering of the brushes.

Another object of the invention is to provide a series of pivotally mounted brushes whereby the brushes, in their travel over the playing surface of a tennis court, will redistribute the pebbles over the surface area and thus ensure a smooth and level surface for the playing area of the court.

While the design and construction of the invention, as illustrated are deemed preferable, it is obvious that the invention may be susceptible of changes and the right to these changes is claimed provided they are within the limits of the claims as set forth herewith.

DESCRIPTION OF THE PREFERRED EMBODIMENT

Figure 1:
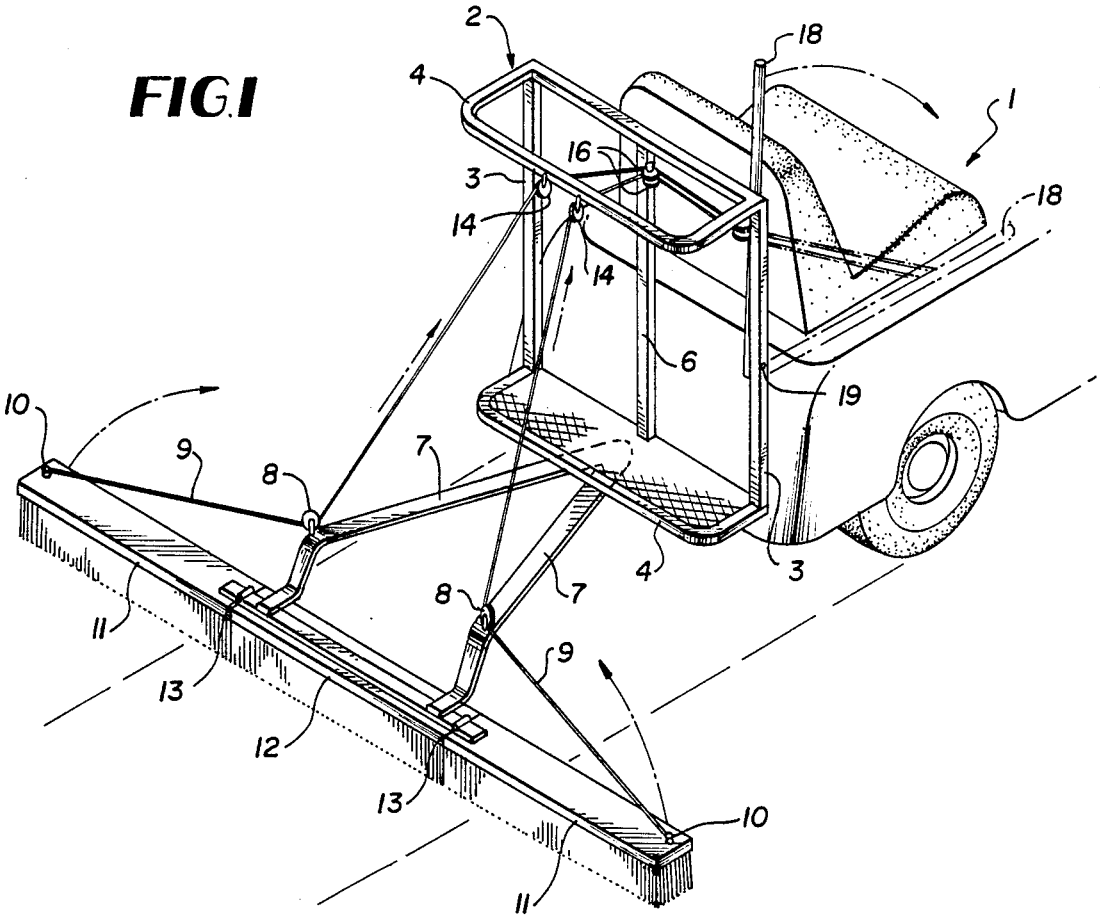
FIG. 1 is a perspective view showing the attachment of the present invention mounted to a towing vehicle and, FIG. 2 is a rear view of the attachment shown in FIG. 1 of the drawings.

Referring now to the drawings wherein like reference characters are employed to denote like parts throughout the several views, numeral 1 denotes a towing vehicle for the attachment which may be a motorized golf cart of conventional construction.

Secured in any known manner to the rear area of the vehicle 1 is a framework 2 comprising a pair of upright members 3 and a cross bar 4 provided at the upper portion of the upright members 3. A like cross bar 5 is provided at the lower portion of the upright 3. A central vertically extending upright bar 6 is provided between the aforesaid uprights 3. This constitutes a framework which may be secured in any known manner to the rear portion of the towing vehicle 1.

Secured in any known manner to the rear portion of the towing vehicle 1 is a V-shaped drawbar 7 which has mounted thereon a pair of pulleys 8 through which extends a pair of cables 9, one end of each being securely fastened to a pair of stationary anchors 10 mounted on pivoted brush sections 11 which extend on either side of a centrally located brush section 12. Brush sections 11 are hingedly connected to center brush 12 as at hinge 13.

As seen in FIG. 1 of the drawings, cables 9 extend from the anchors 10 through pulleys 8, thence through pulleys 14, secured to the framework 2, thence through pulleys 15, and then through pulleys 16 mounted on the vertical bar 6 and then extend to a stationary anchor 17, mounted on an operating handle 18, pivoted as at 19 to one of the upright members 3.

The brush sections 11, 12, are of conventional construction, the bristles thereof being of sufficient stiffness to redistribute the pebbles over the entire surface of the court. p As is well known, tennis courts are usually enclosed on all sides and access thereto is usually through a gateway of rather restricted dimension. Thus, to permit access to and from the playing area of the court the vehicle must be of such dimension as to permit the access to and from the court through the restrictive gateway. A conventional motorized golf cart has been found to be ideal for propelling the attachment over the playing surface of the court and since a golf cart is of rather narrow dimension, the vehicle can easily enter into and out of the playing surface of the court.

Figure 2:
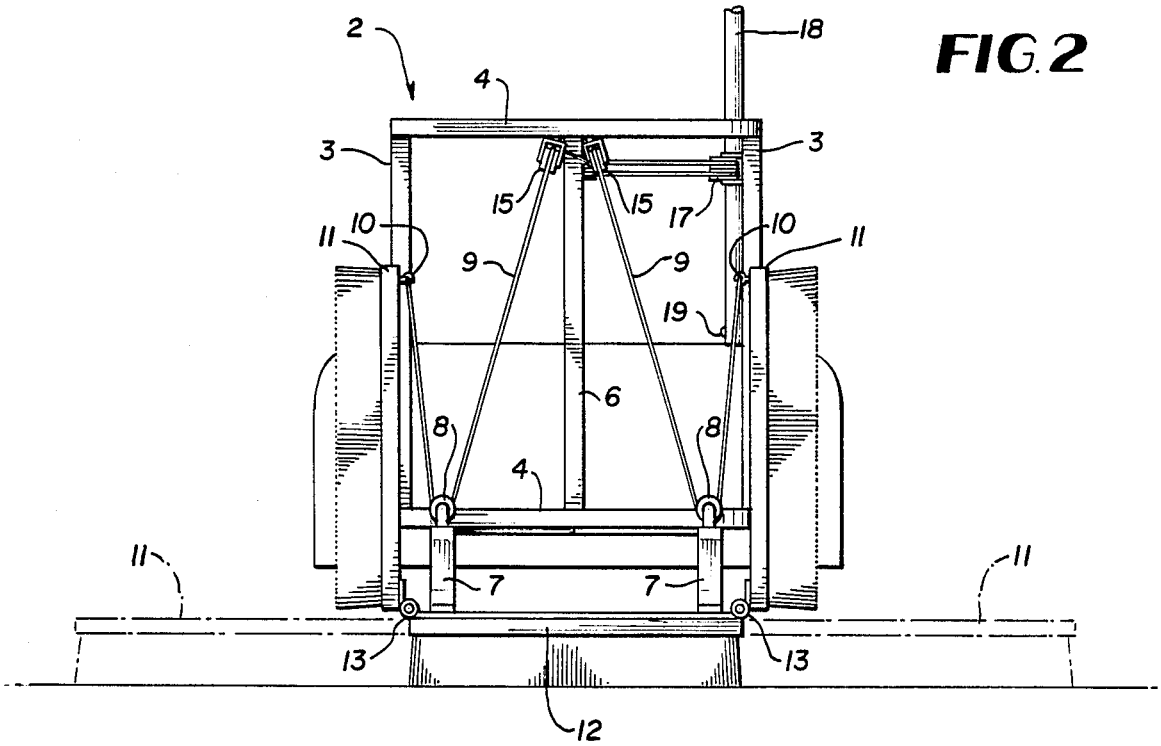

In use, the brush sections extend in a substantially horizontal plane as shown in FIGS. 1 and 2 of the drawings. When it is desired to exit to or from the playing surface of the court, the operator of the vehicle manually actuates the operating handle to a position shown in dotted lines in FIG. 1 of the drawings to effect a swinging of the brushes from a horizontal position to a vertical position as shown by the arrows in FIG. 1 of the drawings. With the brushes in a upright or vertical position, the motorized vehicle can readily be driven onto the playing surface of the court through the restricted entrance area.

While the foregoing description sets forth the invention in specific terms, it is to be understood that numerous changes may be resorted to without departing from the spirit and scope of the invention as claimed hereafter.

I claim:

1. A grooming attachment employed in the regrooming of the playing surface area of a tennis court comprising a motorized vehicle for pulling the attachment over the said area, a pair of uprights and cross bars mounted rearwardly of the said vehicle, a central upright bar extending between said upright and cross bars, a draw bar secured to said vehicle, pulleys secured to said draw bar, pulleys mounted on said upright and cross members, cables extending through all of the aforesaid pulleys and one end thereof secured to an operating handle, the opposite end of said cables secured to anchors provided on each of a pair of pivoted brushes whereby upon actuation of the said handle, the said brushes may be elevated to an upright vertical inoperative position from a substantially horizontal operative position to thus enable the towing vehicle and attachment secured thereto to be driven on to and from the playing area of a tennis court.

2. The structure recited in claim 1 whereby the brushes when extended in a horizontal plane engage the playing surface of a tennis court.

3. The structure recited in claim 1 whereby when the brushes are in an upright vertical position the vehicle and attachment may be driven on to and from the tennis court area through a restrictive gateway for the court.

* * * * *